United States Patent [19]

von Beckmann

[11] 4,111,129

[45] Sep. 5, 1978

[54] METHOD AND APPARATUS FOR THE VIBRATORY TAMPING OF RAILWAY TRACKS

[75] Inventor: Helmuth von Beckmann, Columbia, S.C.

[73] Assignee: Canron Railgroup, West Columbia, S.C.

[21] Appl. No.: 672,498

[22] Filed: Mar. 31, 1976

[51] Int. Cl.[2] ..... E01B 27/16

[52] U.S. Cl. ..... 104/12; 104/10

[58] Field of Search ..... 104/10, 11, 12, 13, 104/7 R, 7 A, 7 B, 8

[56] References Cited

U.S. PATENT DOCUMENTS

| | | | |
|---|---|---|---|
| 3,012,516 | 12/1961 | Alleman | 104/12 |
| 3,177,813 | 4/1965 | Stewart | 104/12 |
| 3,387,567 | 6/1968 | Reynolds | 104/12 |
| 3,608,496 | 9/1971 | Schenkir et al. | 104/12 |
| 3,621,786 | 11/1971 | Joy | 104/12 |
| 3,735,708 | 5/1973 | Plasser et al. | 104/12 |
| 3,797,397 | 3/1974 | Eisenmann et al. | 104/12 |
| 3,807,311 | 4/1974 | Plasser et al. | 104/12 |
| 4,010,692 | 3/1977 | Goel | 104/7 |

FOREIGN PATENT DOCUMENTS 1,599,939 8/1970 France.

*Primary Examiner*—Drayton E. Hoffman
*Assistant Examiner*—Carl Rowold

[57] ABSTRACT

The present invention relates to a method of an apparatus for tamping the ballast of a railroad track in which a vibration imparting tamping means is inserted into the ballast adjacent a tie to be tamped and the vibration of the tamping means is increased in frequency until it imparts a vibratory excitation to the ballast of between 55 and 75 Hz producing a resultant force directed at an angle towards the underside of the tie to be tamped, whereby to consolidate the ballast beneath and adjacent the tie during the excitation period and thereafter reducing the vibration to below 55 Hz. and withdrawing the tamping head from the ballast.

3 Claims, 6 Drawing Figures

METHOD AND APPARATUS FOR THE VIBRATORY TAMPING OF RAILWAY TRACKS

BACKGROUND OF THE INVENTION

It has been the custom for some time to consolidate the ballast of a railway track beneath a tie by inserting vibrating tamping blades into the ballast on either side of the tie, moving the tamping blades together so as to squeeze the ballast beneath the tie, and subsequently withdrawing the tamping blades.

More recently, it has been suggested that if respective plates were inserted in the crib on either side of the tie to be tamped and if those plates were vibrated by means of rotating out-of-balance weights, vibration would be transferred from the weights to the plates and through the ballast, whereby to cause the ballast to flow beneath the tie and become consolidated. It has been found that the "dynamic module of elasticity" of railway track ballast, which can be taken as a measure of the strength of the ballast structure, is greatly reduced when the ballast is excited with a vibration frequency of from 55 Hz. to 75 Hz.

SUMMARY OF THE INVENTION

Accordingly, the present invention provides a method of tamping the ballast of a railroad track comprising applying a vibration imparting means to the track; vibrating said means so as to impart an excitation frequency of 55 Hz. to 75 Hz. to the ballast; and consolidating the ballast during excitation.

According to a feature of the invention, the vibration imparting means is vibrated at a lower frequency prior to application of the means to the track and again after the ballast has been consolidated and shaped.

According to a preferred means of operation, the vibration imparting means is vibrated at a first lower frequency and is then inserted into the ballast with the frequency being increased after insertion to a second frequency which imparts an excitation frequency 55 Hz. to 75 Hz. to the ballast. The consolidating and shaping of the ballast takes place while it is excited at these frequencies and after excitation the frequency of the vibration is reduced to a third frequency for withdrawal of the vibration imparting means from the ballast. The first and third frequencies may be the same and may be zero.

The present invention also provides apparatus for tamping the ballast of a railroad track comprising a tamping head ballast crib tamping plate means at one side of a tie to be tamped; ballast probe means on the underside of said plate for ballast penetration; vibratory drive means mounted on said plate means; means for driving said vibratory drive means to impart vibratory excitation to the ballast from 55 Hz. to 75 Hz. with a resultant force produced thereby directed at an angle between vertical and horizontal toward the underside of said tie; and means for suspending said tamping head so that it can move in the direction of the resultant force.

The vibratory drive means may suitably be an arrangement of two or a series of out-of-balance or eccentric weights, preferably being positioned at a different respective vertical height. The position of the eccentric portion of each weight may be arranged relative to the eccentric portions of the remaining weights whereby a line of resultant force is produced upon rotation of the weights that is desirable with respect to the particular ballast conditions under which the tamping means is operating.

According to the preferred embodiment, the ballast probe means are finger members, one of said finger members being positioned at each of the respective four corners of a rectangular plate means and depending therefrom. The finger members may be, according to a further preferred embodiment, inclined from the underside of the plate means inwardly towards a tie to be tamped.

According to a feature of the invention the driving means for driving the eccentric weight means includes a means for changing the driving speed whereby to vary the vibration frequency.

DESCRIPTION OF THE DRAWINGS

The following is a description by way of an example of certain embodiments of the present invention, reference being had to the accompanying drawings in which.

DESCRIPTION OF THE SPECIFIC EMBODIMENTS

Figure 1:
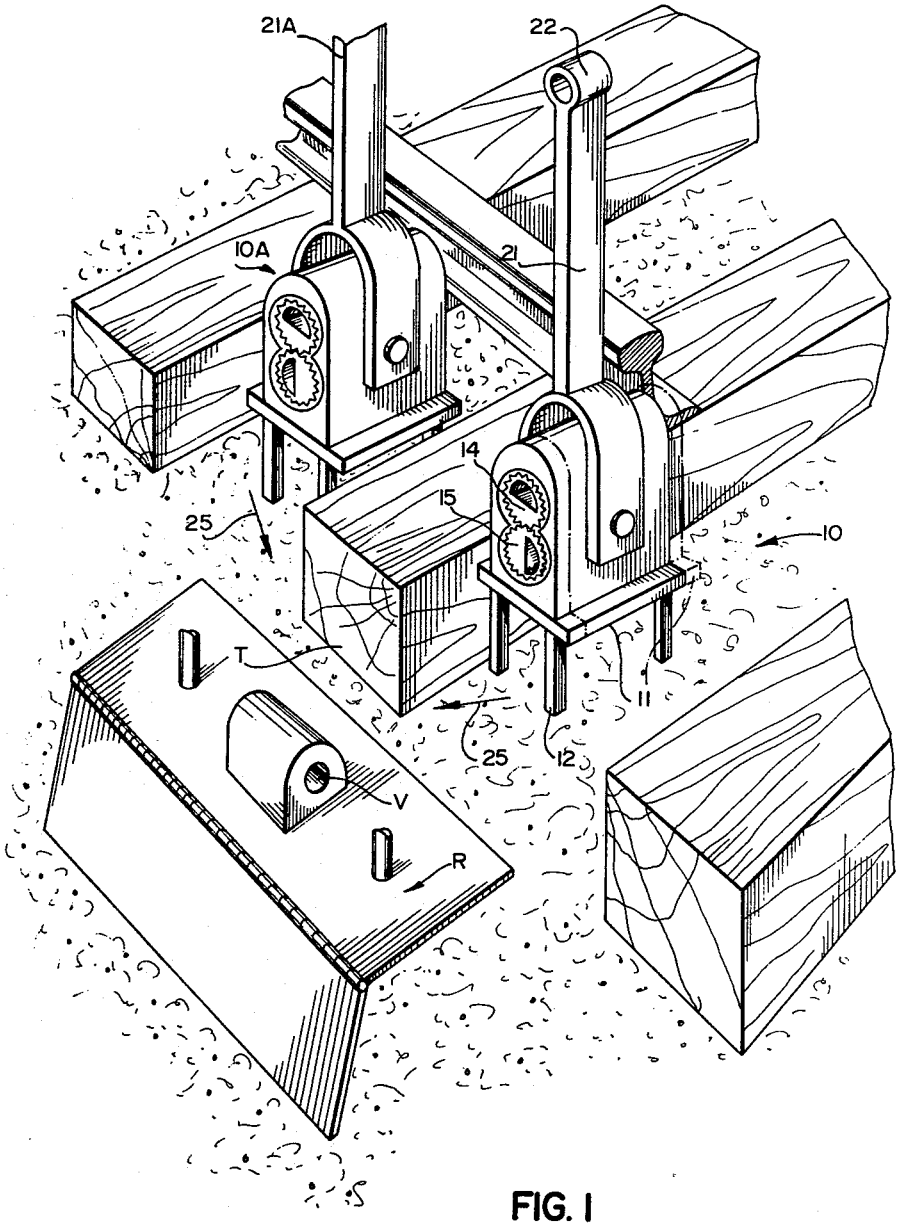
FIG. 1 is a diagrammatic representation of one form of tamping head inserted in a crib at one side of a tie with a cooperating tamping head being positioned in the adjacent crib on the other side of the tie and a shorter ballast retainer being located outside the tie being tamped.
Figure 3:
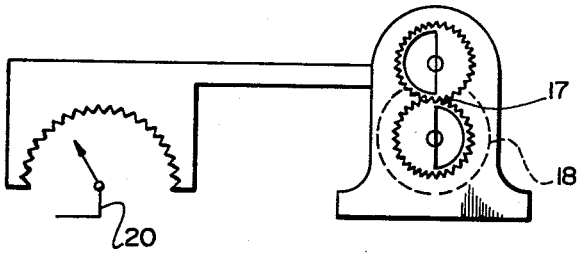
FIG. 3 is a diagrammatic representation of the driving means.
Figure 4:
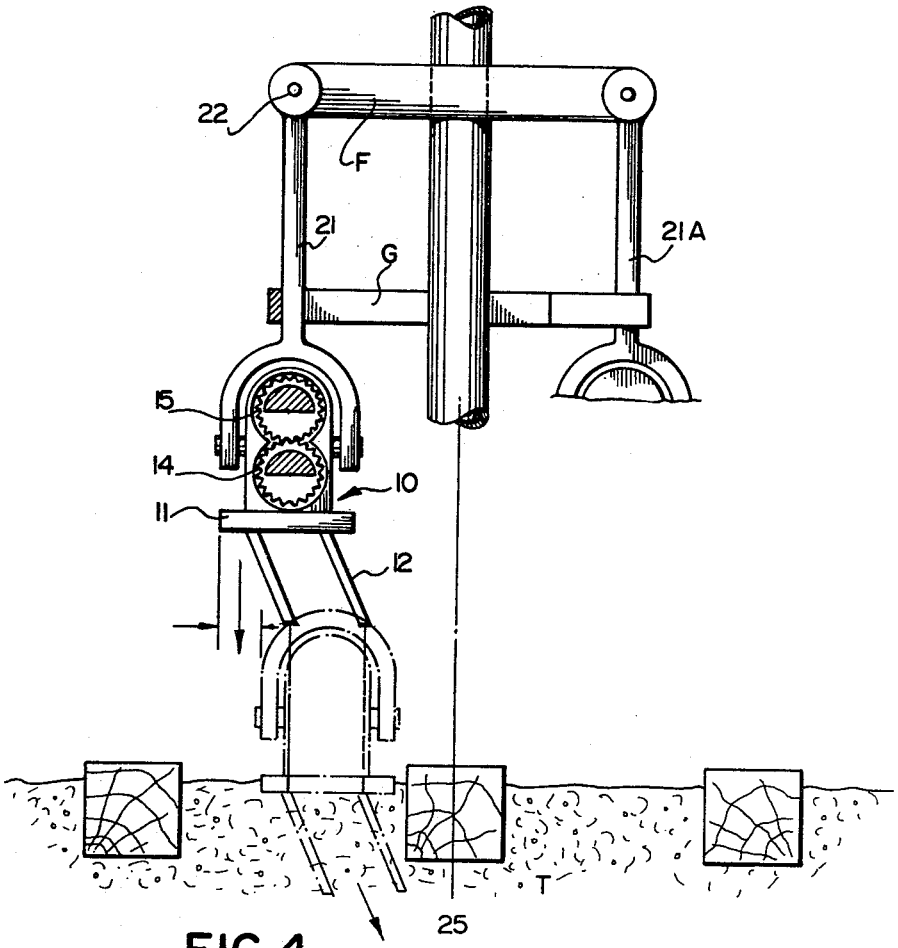
FIG. 4 is a diagrammatic representation of a modified tamping head, similar to that of FIG. 1, in an out of ballast and an in ballast configuration.

Referring now to the drawings in which like parts have been given like numerals:

A vibratory tamping head 10 has a ballast tamping plate 11 from which depend ballast probes comprising fingers 12 mounted on the underside of the rectangular plate 11 and depending therefrom. The fingers may be vertically oriented as seen in FIG. 1 or inclined as shown in FIG. 4. Conveniently, there may be four fingers positioned one at each of the plate corners. The head may have a vibrator of two driven out-of-balance weights schematically shown at 14 and 15 of a form known in the art. These weights are conveniently driven in a manner best seen in FIG. 3 by meshing gears 17 (see also FIG. 5) driven by an electric motor 18 which may be under the control of a variable resistance 20. The head 10 is elastically suspended, using elastic or rubber mounts, on a suspension arm 21 pivoted at 22 on a vertically movable frame F (FIGS. 2 and 4) attached to a tamping machine. A second tamping head 10A is suitably mounted on a suspension arm 21A likewise mounted on the machine frame F so that it can be inserted in the crib at the other side of the tie T to be tamped. If desired the heads 10 and 10A could be arranged inside the rail R in adjacent cribs or four heads could be provided, two as shown in FIG. 1 and two more inside the rail R.

Figure 5:
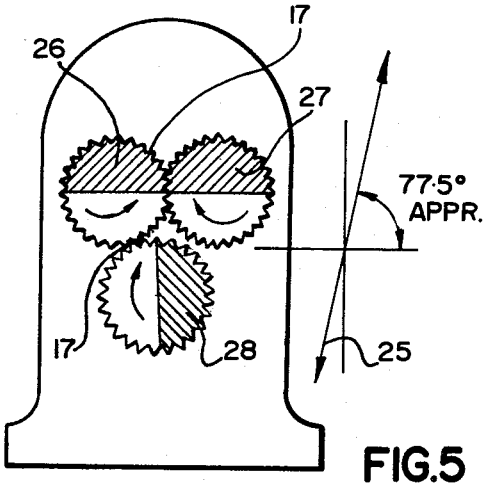
FIGS. 5 and 6 show modified arrangements of the eccentric weights on the tamping head.
Figure 6:
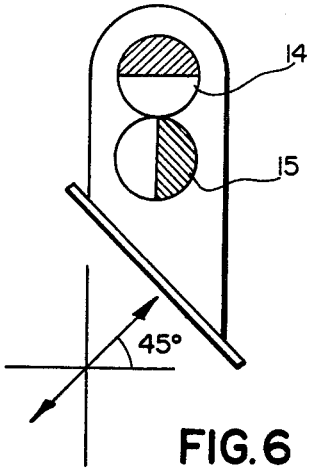

The eccentric weights in the heads are arranged such that on rotation, a resultant force will be produced on the tamping head in the appropriate direction of the arrow 25, that is, at an angle between the vertical and horizontal towards the underside of the tie T. For example, in FIGS. 1 and 6, the eccentric weights 14, 15 are arranged to produce a line of resultant force 25 directed at an angle of approximately 45° from the horizontal, whereas FIG. 5 shows an arrangement of three weights 26, 27, 28 which will produce a line of resultant force 25 directed at an angle of approximately 77.5° from the horizontal. Accordingly, the line of resulting force desired may be varied according to ballast conditions or tamping head configuration, the main consideration being to obtain the required shape of the ballast at the point under the tie or rail where the best supporting results for the track are obtained.

A shoulder ballast retainer R of known configuration may be mounted in conventional fashion on the tamping machine to engage the shoulder ballast adjacent the tie T being tamped. The ballast retainer may conveniently have a vibrator V such as the out-of-balance weights 14 and 15.

Figure 2:
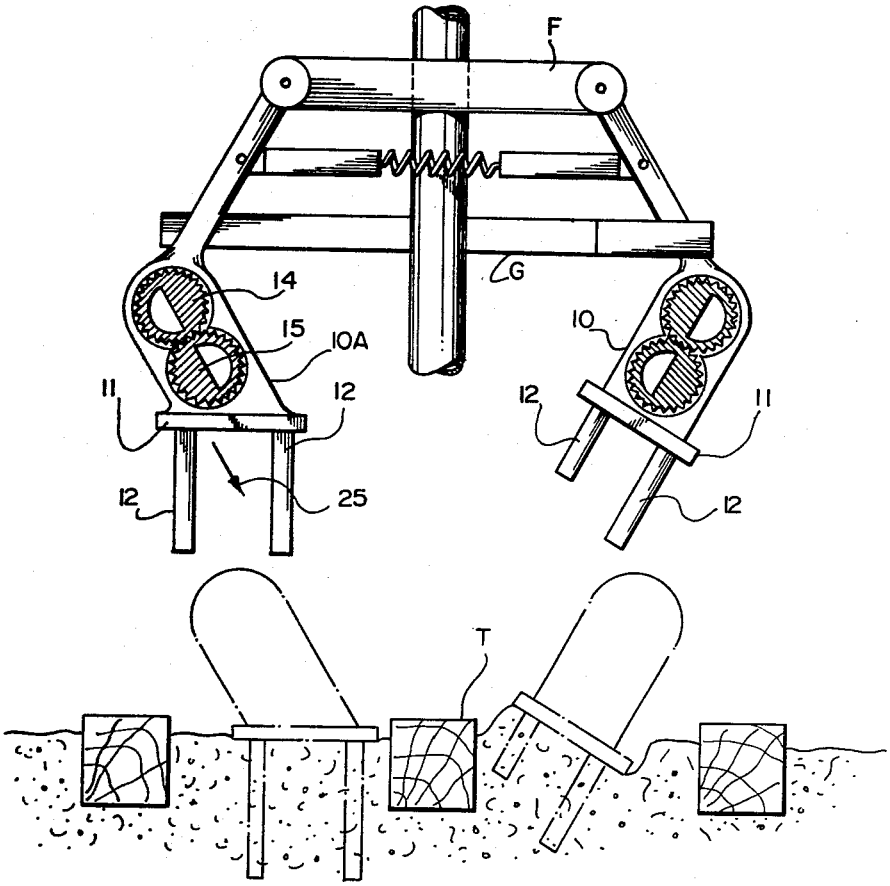
FIG. 2 shows two other forms of tamping heads.

In FIG. 2, two alternative forms of tamping head are shown in which the out-of-balance weights 14 and 15 are positioned one above the other along the angle of application of the resultant and in one form the plate 11 and fingers 12 are inclined, the fingers 12 on the right hand side being shown of unequal length.

In operation the pair of tamping heads 10 and 10A are lowered on frame F through guides G (FIGS. 2 and 4) into contact with the ballast in the cribs on either side of the tie T, the finger members 12 penetrate into the ballast and the ballast contacting plate 11 rests on or near the top of the ballast. The tamping heads 10 could be stopped during lowering but are preferably vibrated at a frequency of 35 Hz. As soon as the heads have entered the ballast, a motor is started or the rotary switch 20 (if provided) is activated so that the speed of rotation of the eccentric weights 14 and 15 is increased until the ballast beneath the tie T is excited by the vibration imparted thereto at a frequency of about 55 Hz. to 75 Hz. If ballast shaping is desired the shoulder ballast retainer R is moved into contact with the shoulder ballast and similarly vibrated. Grain size, moisture content etc. changes the ballast response and certain common ballast conditions have response best to frequencies in the 75 Hz. range. The desired effect has been found to be produced between 55 Hz. and about 75 Hz. At this range of frequencies, the internal friction within the ballast structure rapidly decreases and the ballast becomes very fluid.

The position and angular orientation of the eccentric weights 14 and 15 result in the tamping head 10 being moved in the direction of the arrow 25, through the highly fluidized ballast towards the tie T which consolidates the ballast to the desired configuration beneath the tie. As soon as the consolidating, and shaping if desired, has been completed, the speed of rotation of the eccentric weights 14 and 15 (FIG. 2), or 26, 27 and 28 (FIG. 5), is reduced or they are stopped so that they impart an excitation of less than 55 Hz. and the tamping heads (and retainer R, if used) are withdrawn. It is desirable to select the lower frequency and withdraw the tamping head in order to "freeze" the ballast configuration after it has been shaped and consolidated. On withdrawal of the tamping heads in guides G they are returned to their starting position by spring S (FIG. 2).

It has to be understood that the increase in vibration to the higher frequencies could start prior to insertion into the ballast of the tamping heads 10 and 10A and then continue but it is preferred to first insert the tamping heads and then boost the speed to the required frequency.

Furthermore, although this invention has been described with reference to out-of-balance vibrators, other type of vibrators capable of generating the required frequencies could be used, for example, any hydraulic, electric or pneumatic reciprocating or rotating motor.

Still further, it will be understood that where penetration towards the base of the rail is desired, this can be achieved by eccentrically mounting the vibrator plates 11 and their vibrators, off-centre with respect to suspension arms 21 (one of the vibrating heads mounted in this fashion is shown in chain dotted line in FIG. 1). Under these conditions a tipping action of plate and vibrator results when a downward force is exerted by arm 21, resulting in penetration by the probes towards the base of the rail.

What I claim as my invention is:

1. A method of tamping the ballast of a railroad track comprising applying a succession of tamping steps at a series of points along the track, each step comprising vibrating a vibration imparting means at a first frequency; inserting said means into said ballast; increasing the frequency of vibration of said means to a second frequency so as to impart an excitation frequency to the ballast; shaping the ballast whilst it is so excited; reducing the frequency of vibration of said means to a third frequency; and withdrawing said means from said ballast.

2. A method as claimed in claim 1, in which the first and third frequencies are the same.

3. A method of tamping as claimed in claim 1 in which said second frequency is between 55 Hz. and 75 Hz.

* * * * *